United States Patent [19]

Bauer et al.

[11] Patent Number: 4,803,323

[45] Date of Patent: Feb. 7, 1989

[54] ELECTRIC MANUAL SWITCHING DEVICE HAVING ENVIRONMENTALLY PROTECTED COMPONENTS

[75] Inventors: Karl-Heinz Bauer; Gerold Eckert, both of Bad Neustadt/Saale, Fed. Rep. of Germany

[73] Assignee: Preh Elektrofeinmechanische Werke Jakob Preh Nachf. GmbH & Co., Bad Neustadt/Saale, Fed. Rep. of Germany

[21] Appl. No.: 8,823

[22] Filed: Jan. 30, 1987

[30] Foreign Application Priority Data

Feb. 5, 1986 [DE] Fed. Rep. of Germany ..... 8602882

[51] Int. Cl.[4] ..... H01H 13/06

[52] U.S. Cl. ..... 200/302.2

[58] Field of Search ..... 200/302.2, 302.1

[56] References Cited

U.S. PATENT DOCUMENTS

| | | | |
|---|---|---|---|
| 3,911,241 | 10/1975 | Jarrard | 200/302.2 |
| 3,995,128 | 11/1976 | Hawkins | 200/302.2 |
| 4,066,870 | 1/1978 | Colten | 200/302.1 |
| 4,352,968 | 10/1982 | Pounds | 200/302.2 |
| 4,545,375 | 10/1985 | Cline | 200/302.2 |

OTHER PUBLICATIONS

Elliot, J. F., *Dustproof Switch,* Jan. 1969, IBM Tech Disclosure-vol. 11, No. 8, p. 1006.

*Primary Examiner*—Renee S. Luebke

*Attorney, Agent, or Firm*—Woodcock, Washburn, Kurtz, Mackiewicz & Norris

[57] ABSTRACT

In an electric manual switching device, a printed circuit board is to be protected from environmental influences. For this purpose, a foil continuously extending over the printed circuit board is provided in the switch housing between switching contacts and pushbuttons. The foil can be a flat component or a part shaped like a bag.

1 Claim, 2 Drawing Sheets

ELECTRIC MANUAL SWITCHING DEVICE HAVING ENVIRONMENTALLY PROTECTED COMPONENTS

FIELD OF THE INVENTION

This invention relates to an electric manual switching device having a printed circuit board which is supported in a housing. More specifically, this invention relates to an electric manual switching device with a printed circuit board having switching contacts which are faced by pushbutton elements disposed at the housing and which are connected with a connecting cable via printed circuit board conductors.

BACKGROUND OF THE INVENTION

Manual switching devices of this kind are used, for instance, in motor vehicles for controlling various functions. Such manual switching devices are often exposed to the unfavorable influences of moisture, wetness, dust, sulphur and other atmospheric substances. With the known manual switching devices, moisture or dust can reach the switching contacts and the circuit board conductors. This can result in a considerable number of malfunctions of the switching device.

SUMMARY OF THE INVENTION

It is the object of this invention to propose a manual switching device of the above-mentioned type, the printed circuit board of which is protected from environmental influences.

According to the invention, the above object is achieved in that a foil extending continuously over the printed circuit board is disposed in the switch housing between the switching contacts and the pushbutton switching elements. The foil consists of a flexible material and seals the switching contacts with the circuit board conductors from the interior of the housing.

The foil ensures that when moisture, wetness or dust reaches the interior of the housing, the switching contacts and the circuit board conductors are protected from such adverse environmental influences. This insures considerably higher operational reliability. The foil, being made of a flexible material, does not impair the switching performance of the switching contacts.

In one embodiment of the invention, the foil rests on the printed circuit board as a flat component.

In another embodiment of the invention, the foil is shaped like a hose or a bag. The printed circuit board with the switching contacts is inserted into the foil. The foil is tightly closed at its two ends, with the connecting cable extending from one end.

BRIEF DESCRIPTION OF THE DRAWINGS

The present invention may be better understood and its numerous objects and advantages will become apparent to those skilled in the art by reference to the accompanying drawings in which.

DESCRIPTION OF THE PREFERRED EMBODIMENT

Configuration of the Apparatus

Figure 1:
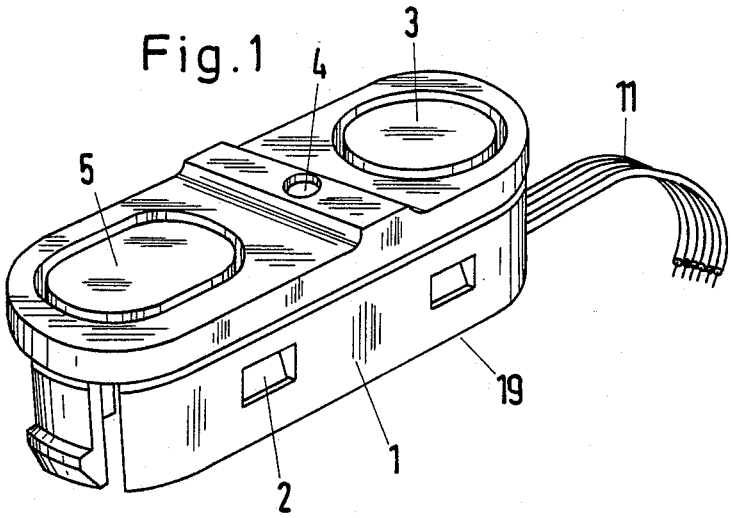
FIG. 1 shows a perspective view of a manual switching device which embodies the present invention.
Figure 2:
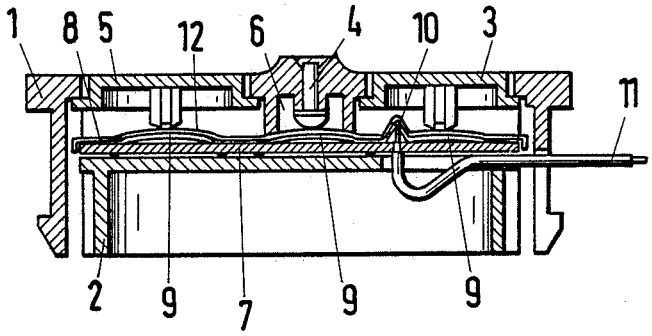
FIG. 2 shows a cross-sectional view of the manual switching device of FIG. 1.

Referring first to FIG. 1, a housing of an electric manual switching device 19 comprises an upper part 1 of the housing into which a lower part 2 of the housing is snapped. Pushbuttons 3, 4 and 5 are supported in the upper part 1 of the housing. Turning next to FIG. 2, in the interior 6 of the housing, between the lower part 2 and the upper part 1, a printed circuit board 7 is mounted, having disposed on its top side 8 circuit board conductors which are not displayed in detail. Below the pushbuttons 3, 4 and 5, switching contacts 9 are provided on the top side 8 of the printed circuit board 7. A connecting cable 11 is connected with the circuit board conductors at soldering eyelets 10. A foil 12 is placed on the top side 8 of the printed circuit board 7 and over the switching contacts 9 and the soldering eyelets 10.

Figure 3:
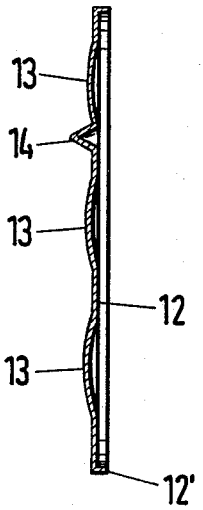
FIG. 3 shows a side view of a foil formed as a flat component according to FIG. 2.
Figure 4:
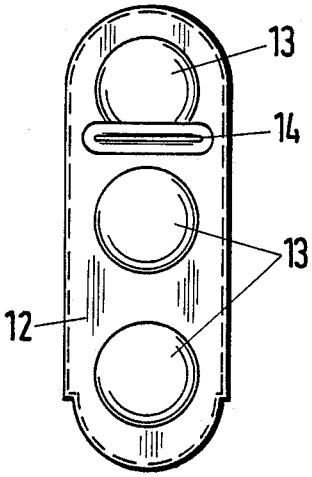
FIG. 4 shows a top view of the foil according to FIG. 3.

Turning next to FIG. 3, the relationship between the printed circuit board 7 and the foil 12 is shown in greater detail. To clearly show this relationship, switch contacts 9 and soldering eyelet 10 have been omitted from FIG. 3. The foil 12 is made of a formed, smooth and supple plastic material or rubber. Elevations 13 are provided on the foil 12 for the switching contacts 9. A further elevation 14 is provided for the soldering eyelets 10. By means of a border 12', the foil 12 reaches around the edge of the printed circuit board 7, to thus completely cover the top side 8 of printed circuit board 7.

If moisture or dust enter the interior 6 of the housing through the gaps between the upper part 1 of the housing and the pushbuttons 3, 4 and 5 or the lower part 2 of the housing, the moisture or dust cannot reach the top side 8 of the printed circuit board 7 or the switching contacts 9 since the foil 12 continuously covers the top side 8. Further, since the printed circuit board 7 has no openings or passages, it is also impossible for moisture to reach the switching contacts 9 from below.

Operation of the Apparatus

When actuation of pushbuttons 3, 4 or 5 is desired, the operator pushes down on the selected pushbutton. Actuator 20, which is included as part of each respective pushbutton 3, 4 and 5 is directed towards the interior of electric manual switching device 19 until actuator 20 contacts an elevation 13 or 14 of foil 12. Continued pressure on pushbutton 3, 4 or 5 will depress the corresponding elevation which in turn will depress a switch contact 9 until the switch contact is pressed against a printed circuit board conductor to complete an electrical connection between the switch contact 9 and the connecting cable 11 via the printed circuit board conductor and thus communicate the actuation of the pushbutton to an electrical device (not shown) in connection with connecting cable 11.

Alternate Embodiments of the Invention

Figure 5:
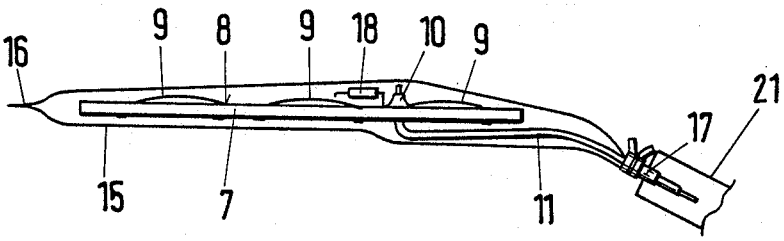
FIG. 5 shows a printed circuit board in a hose-shaped foil

In the alternate embodiment of the invention according to FIG. 5, the printed circuit board 7 with the switching contacts 9 and with both active and passive electric components, e.g. fixed resistor 18, provided on top side 8 of printed circuit board 7, is inserted in a foil 15 formed like a bag. The foil 15 is made of a blown tubing and is tightly closed at the end 16. The opposite end 17 is tightly fitted to the connecting cable 11. The printed circuit board 7 protected in this way is mounted between the upper part 1 of the housing and the lower part 2 of the housing, as is shown in FIG. 2. Similar to the performance of foil 12 of FIG. 2, foil 15 does not impair the switching performance of the switching contacts 9. The foil 15 is even considerably thinner than the foil 12, e.g. less than 50μ. Such foils, which are free of additives having a disadvantageous influence on electrical contact surfaces, are used for instance in food packaging. Such a foil is produced, e.g. of high molecular low-pressure polyethylene, with a foil thickness of 10 to 20μ.

In a further embodiment of the invention, the end 17 of the foil 15 is extended to a plug element, inserted into the plug element 21 and sealed there. The sealing can be carried out in this case for instance by means of a flexible nozzle, by a shrink sleeve or by a compression screw connection.

Thus, there has been described and illustrated herein an electric manual switching device having switching contacts and a printed circuit board protected from adverse environmental influences. However, those skilled in the art will recognize that many modifications and variations besides those specifically mentioned may be made in the techniques described herein without departing substantially from the concept of the present invention. Accordingly, it should be clearly understood that the form of the invention described herein is exemplary only, and is not intended as a limitation on the scope of the present invention.

What is claimed is:

1. An electrical manual switching device comprising a housing; a printed circuit board having electrical conductors disposed thereon, said printed board mounted in said housing; a plurality of switching contacts provided on said printed circuit board; a plurality of pushbutton elements disposed on said housing, each of said plural pushbutton elements facing a corresponding one of said plural switching contacts; and a connecting cable, said switching contacts capable of electrical connection with said connecting cable via said electrical conductors; characterized in that said electrical manual switching device further comprises a foil extending continuously over said printed circuit board, said foil being disposed in said housing between said switching contacts and said pushbutton switching elements wherein said foil consists of a flexible material and seals said switching contacts and said printed circuit board conductors from the interior of said housing, said foil shaped like a bag, said printed circuit board with said switching contacts being inserted into said foil, said bag-shaped foil loosely enclosing said printed circuit board with said switching contacts, said foil tightly closed at both ends, with said connecting cable extending from one end, said foil introduced at said one end into a plug connection.

* * * * *